United States Patent [19]

Murai et al.

[11] 4,440,090

[45] Apr. 3, 1984

[54] STORAGE ARRANGEMENT FOR TRUCK CONVEYOR TROLLEYS

[75] Inventors: Masasumi Murai; Hirokazu Kondo, both of Tokorozawa; Shigekatzu Takino, Hanno, all of Japan

[73] Assignee: Tsubakimoto Chain Company, Osaka, Japan

[21] Appl. No.: 348,777

[22] Filed: Feb. 16, 1982

[30] Foreign Application Priority Data

Nov. 27, 1981 [JP] Japan .....

[51] Int. Cl.[3] ..... B61B 10/00; B65G 63/00; E04H 6/20

[52] U.S. Cl. ..... 104/127; 104/128; 104/172 B; 198/648; 414/235

[58] Field of Search ..... 104/48, 98, 127, 128, 104/129, 172 B; 198/472, 648; 414/234, 235, 239, 240

[56] References Cited

U.S. PATENT DOCUMENTS

| | | | |
|---|---|---|---|
| 3,301,413 | 1/1967 | Coursey | 104/172 B X |
| 3,518,946 | 7/1970 | Kavieff | 104/172 B |
| 3,611,946 | 10/1971 | Heximer et al. | 104/127 |
| 3,693,392 | 9/1972 | Watson | 104/172 B |
| 3,737,057 | 6/1973 | Neumann et al. | 414/239 X |
| 3,882,793 | 5/1975 | Wakabayashi | 104/172 B X |

FOREIGN PATENT DOCUMENTS

| | | |
|---|---|---|
| 47-38391 | 9/1972 | Japan . |
| 53-15272 | 5/1978 | Japan . |
| 53-15273 | 5/1978 | Japan . |

*Primary Examiner*—Robert B. Reeves
*Assistant Examiner*—David F. Hubbuch
*Attorney, Agent, or Firm*—Dann, Dorfman, Herrell and Skillman

[57] ABSTRACT

Storage arrangement for truck conveyor trolleys is provided wherein trolley units are designed to run within a conveyance path defined by a trolley rail. The trolley units are engageable with a truck for receiving articles to be carried and can be attached and detached from the truck by positioning the trolley units on segmented rail portions integrally formed as part of the trolley running rail. By raising or lowering the scissioned rail segments with the trolley units positioned thereon, the trolley units will automatically engage with and disengage from the truck. Once disconnected from the truck, the trolley units can be stored in large numbers in a storage place, either on the rail segments or on separate storage rails.

12 Claims, 9 Drawing Figures

STORAGE ARRANGEMENT FOR TRUCK CONVEYOR TROLLEYS

FIELD OF INVENTION

The present invention relates to a trolley storage arrangement for a truck conveyor whereby a truck, and front and rear trolley units engageable with the truck are separated from each other and unused trolley units are stored outside the conveyor path, and the stored trolley units can be drawn out and brought into engagement with the truck whenever required.

BACKGROUND OF INVENTION

In the conventional truck conveyors for the conveyance of long articles, trolleys are mounted in a projecting manner in front and in the rear of a truck as is described in Japanese Patent Publications Nos. 38391/1972, 15272/1978 and 15273/1978. In the truck conveyor disclosed in the patent publication No. 38391/1972, however, plural trolleys are all integrally connected by a connecting bar (40) and the overall length thereof is larger than the truck, so that a great increase in the storage area for this traction trolley unit is unavoidable. Moreover, in the truck conveyors disclosed in the patent publications Nos. 15272/1978 and 15273/1978, a leading trolley 14 and a trailing trolley 15, though not directly connected, are connected respectively to the front and rear portions of a truck through a connecting bar 12, so that the truck and the trolleys are not easily separable from each other, and therefore, when only the trolleys are to be stored, it is necessary to perform the operation for disconnection between the connecting bar or the truck and the trolleys.

SUMMARY OF INVENTION

In accordance with the present invention, a novel storage arrangement for conveyor trolleys is provided. The trolleys of the storage arrangement include a front trolley unit and a rear trolley unit. An article carrier for receiving an article for conveyance is provided having trolley-engagement means detachably engageable with the front and rear trolley units at the respective front and rear of the article carrier. A stationary trolley rail is employed for guiding the front and rear trolley units along a selected conveyance path, the front and rear trolley units having rail-engagement means for engaging the rail. Storage rails are provided at a selected storage location along the conveyance path for storing the front and rear trolley units. Transfer rails are provided at the storage location, the transfer rails having a first position to enable transfer of the front and rear trolley units between the stationary and transfer rails. The trolley-engagement means of the article carrier is engageable with the front and rear trolley units when the transfer rail is in the first position. The trolley-transfer rails also have a second position to enable transfer of the front and rear trolley units between the transfer rails and the storage rails. The trolley-engagement means are disengaged from said front and rear trolley units when the transfer rail is in the second position. The storage apparatus includes transfer-rail displacement means for displacing the transfer rails between the first and second positions. Trolley-unit transfer means is provided at the storage location for transferring the front and rear trolley units between the storage rails and the transfer rails at the second position.

In an alternative embodiment, the storage arrangement includes a plurality of trolley-storage rails at a selected storage location along the conveyance path for the storage of the front and rear trolley units. Each of the storage rails has an operative position in operable communication with the stationary rail to enable transfer of the front and rear trolley units between the rails. Each trolley-storage rail also has at least one inoperative position out of communication with the stationary rail to enable storage of the front and rear trolley units thereon. Rail displacement means are provided for displacing each storage rail between the operative and inoperative positions.

The present invention, which has eliminated the above-mentioned drawbacks of the prior art, will be described hereinafter with reference to the accompanying drawings.

BRIEF DESCRIPTION OF THE DRAWINGS

The accompanying drawings illustrate embodiments of the present invention, in which.

DETAILED DESCRIPTION OF THE INVENTION

Figure 1:
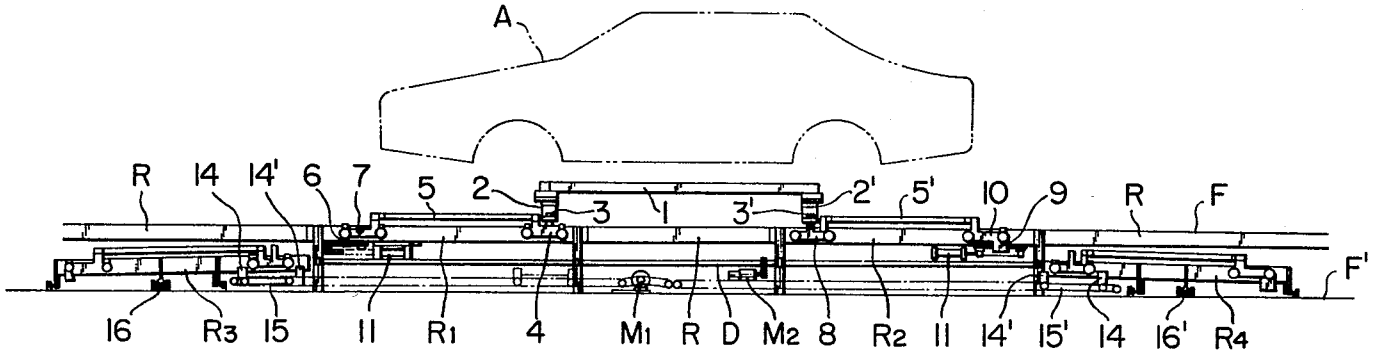
FIG. 1 is a front view of a storage equipment according to an embodiment of the invention, with the principal part illustrated in section.
Figure 2:
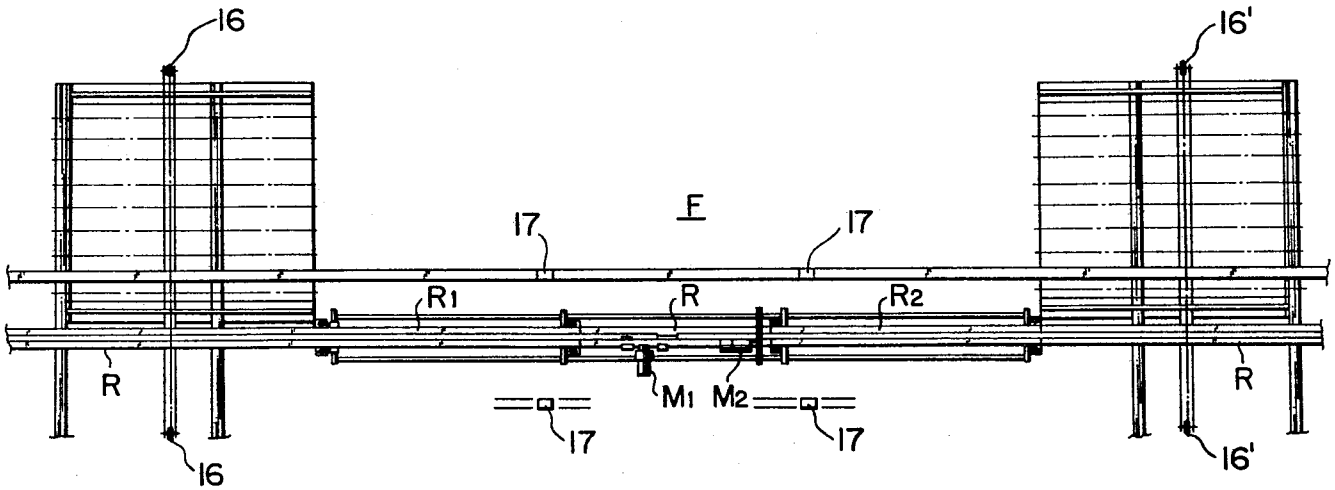
FIG. 2 is a plan view of the principal part thereof.

As illustrated in FIG. 1, a truck 1 carrying thereon a long article A such as an automotive body is supported on a working floor F by channeled l-shaped engaging members 2 and 2' having a vertical web portion with upper and lower horizontal flanges projecting to one side and defining a channel therebetween. The engaging members 2 and 2' are dependent respectively from the front and rear portions of the truck.

A front trolley unit includes a front trolley 4 having a upright pin 3 for insertion into a hole formed through the underside of the front engaging member 2 and a leading trolley 7 connected to the front trolley 4 through a spacer bar 5 and universal joints. The leading trolley 7 has a projecting pusher dog 6 adapted to engage a pusher which is attached to a trolley-driving chain (not shown).

A rear trolley unit includes a rear trolley 8 having an upright pin 3' for insertion into a hole formed through the underside of the rear engaging member 2' and a rearmost trolley 10 connected to the rear trolley 8 through a spacer bar 5' and universal joints. The rearmost trolley has a cam portion 9 for bringing down the above-mentioned pusher to disengage the pusher dog from the pusher. The front and rear trolley units include rail-engagement means such as wheels for engaging a running rail R. The trolley units are guided by the running rail R which is formed by opposing the channeled portions of l-shaped rails laid within the working floor F. The portions of the running rail R where the front and rear trolley units are positioned at the time of storage are separable to form a vertically-movable front scissioned rail segment $R_1$ and a vertically-movable rear transfer rail segment $R_2$. The rail segments $R_1$ and $R_2$ function as transfer rails for moving the trolley units positioned thereon at the storage location vertically between an upper first position and a lower second position.

In the transfer rail segments $R_1$ and $R_2$ there are means for positioning the front and rear trolley units by holding either the pusher dog 6 projecting fom the leading trolley 7 or the cam portion 9 of the rearmost trolley 10. As shown in a bottom view in FIG. 3, a pivotable stopper S is pivotally connected to the lower surface of each of the front and rear rail segments $R_1$ and $R_2$. A cylinder 11 is mounted under the rail portions $R_1$ and $R_2$ and a cam rod 12 is fixed to the tip end of the piston rod of the cylinder 11 so that it can reciprocate within a guide member mounted on the lower surface of each of the rail segments $R_1$ and $R_2$. Attached to the cam rod 12 is a pushing piece 13 which is pivotable only toward the pivotable stopper S.

To cooperate with the transfer rail segments $R_1$ and $R_2$ when they are in lowered position, there are disposed carriers 15 and 15', carried respectively on storage rails $R_3$ and $R_4$ which are laid on a floor F', and on each of the carriers 15 and 15' there are mounted pushers 14 and 14' so as to be pivotable only in the horizontal direction, one set of pushers 14 and 14' being adapted to hold the front trolley 4 and the other set of pushers 14 and 14' being adapted to hold the rear trolley 8 both from the front and behind. The carriers 15 and 15' are connected to a chain which is driven by drive means such as a reversible motor $M_1$.

A plurality of trolley-unit storage rails $R_3$ and $R_4$ are respectively disposed side by side on cross-feed conveyors 16 and 16' so as to be adjacent to the rail segments $R_1$ and $R_2$ and in a slightly falling gradient. In these lower positions, the rail segments $R_1$ and $R_2$ are in communication with the storage rails $R_3$ and $R_4$. The carriers 15 and 15' serve as trolley-unit transfer means and transfer the trolley units between the rail segments $R_1$ and $R_2$ and the storage rails when the rail segments $R_1$ and $R_2$ are at their lower positions.

In operation, the truck which has been moved along a predetermined conveyance path by the trolley driving chain, is drawn into a storage path branched from the conveyance path with no trolley driving chain provided in the storage path. It is pushed manually up to the storage position together with the trolley units which are conducted within the running rail R. In the working floor F in the storage position, there are formed V-grooves 17 for stopping the wheels of the truck in a predetermined position.

When the truck 1 stops in the predetermined position, the front and rear trolley units are positioned on the front transfer rail segment $R_1$ and the rear transfer rail segment $R_2$, respectively. Whereupon the cylinder 11 is actuated to move the cam rod 12 forward until the cam rod 12 abuts the pivotable stopper S whereby the pivotable stopper S is brought from its downward pivoted state into an upright unpivotable restrained state and at the same time, in cooperation wih the pushing piece 13, the pusher dog 6 of the leading trolley or the cam portion 9 of the rearmost trolley 10 is held between the stopper S and the pushing piece 13. Consequently, the front and rear trolley units can be fixed on the front transfer rail segment $R_1$ and the rear transfer rail segment $R_2$, respectively.

When the trolley units have thus been fixed on the transfer rail segments, a reversible drive means, for example a motor $M_2$, is turned on to operate known lift or elevator means through a long driving shaft D to thereby lower the scissioned rail portions together with the trolley units. The motor $M_2$ and the lift means serve as rail-displacement means for displacing the rail segments $R_1$ and $R_2$ between their upper and lower positions. This movement easily disengages the upright pins 3 and 3' of the front trolley 4 and the rear trolley 8 from the holes formed in the trolley-engagement means 2 and 2', respectively, so that the truck 1 is supported on the working floor F and only the trolley units go down to a predetermined lower position while being carried on the rail segments. Then, on the basis of a detected signal from a conventional detecting means, such as a limit switch, the reversible motor $M_2$ is turned off, and the front trolley 4 and the rear trolley 8 are each held between the pushers 14 and 14' of the carriers 15 and 15'. At their lower position, the rail segments $R_1$ and $R_2$ are in operable communication with storage rails $R_3$ and $R_4$, enabling the transfer of the front and rear trolley units onto the storage rails $R_3$ and $R_4$. One of the ends of each of the rail segments $R_1$ and $R_2$ which have been brought down and stopped at the lower position is adjacent to one of the end portions of the plural, juxtaposed storage rails $R_3$ and $R_4$.

Figure 3:
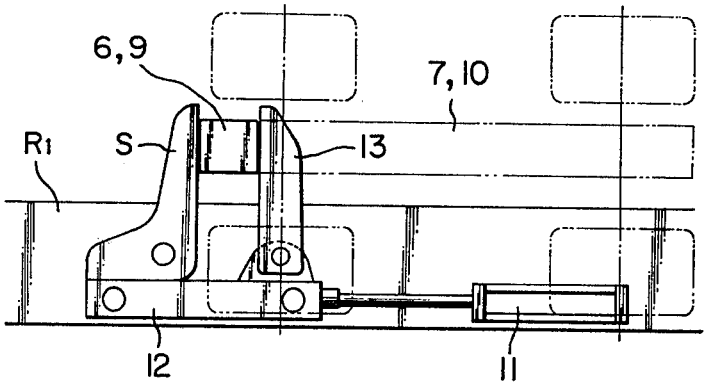
FIG. 3 is an enlarged bottom view of trolley positioning means.

The drive means, such as the cylinder 11 shown in FIG. 3, is actuated to move the cam rod 12 backward to release the restraint of the pivotable stopper S, thereby permitting the pusher dog 6 and the cam portion 9 to move freely in the direction of the pivotable stoppers. Thereafter, by turning on the reversible motor $M_1$, the carriers 15 and 15' are moved toward the storage rails $R_3$ and $R_4$, respectively, thus allowing the pushers 14' of the carriers to push the front trolley 4 and the rear trolley 8, whereby the front and rear trolley units are transferred from the rail segments $R_1$ and $R_2$ onto the storage rails $R_3$ and $R_4$, respectively, in communication with the rail segments $R_1$ and $R_2$. Upon completion of transfer of each trolley unit, the reversible motor $M_1$ is turned off with a detected signal from a conventional detecting means, and storage-rail carrier means such as the cross-feed conveyors 16 and 16', which have storage rails carried thereon in a side-by-side generally parallel arrangement, are operated whereby the storage rails $R_3$ and $R_4$ carrying thereon the trolley units are moved in the storage direction to inoperative positions while pushing open the pushers 14 and 14' in the transverse direction. The next unloaded storage rails are moved in a transverse direction to the parallel arrangement from an inoperative position out of communication with the rail segments $R_1$ and $R_2$ at their lower positions and reach the operative positions adjacent to and in communiation with the rail segments, while the carriers 15 and 15' are returned to the original positions by a reverse rotation of the reversible motor $M_1$. The reversible motor $M_1$ is then turned off. The cross-feed conveyors include drive means for conveying said cross-feed conveyors and function as storage rail displacement means for displacing said storage rails between an operative position in communication with said rail segments in their lower positions and an inoperative storage position out of communication with said rail segments $R_1$ and $R_2$ at their lower positions.

On the other hand, the rail segments $R_1$ and $R_2$ in the lowered positions are moved upward by a reverse rotation of the reversible motor $M_2$, and upon reaching the positions adjacent the trolley running rail R the reversible motor $M_2$ is turned off with a detected signal. Consequently, the trolley running rail R and the rail segments $R_1$ and $R_2$ are adjacent with each other and while in communication with one another wait for the arrival of the next trolley units. Since the lower ends of the engaging members 2 and 2' of the truck are higher than the truck wheel position, the truck 1 which has been disconnected from the trolley units can move quite freely on the working floor F without being restrained by the trolley running rail R and the rail segments $R_1$ and $R_2$.

The operation for repeating the loading of the stored trolley units to the truck can be effected by reversing the foregoing trolley unit storing operation. That is, the wheels of the truck are fitted in the V grooves 17, the trolley units are drawn out from the storage rails onto the rail segments in the lowered positions and the rail segments are moved up, allowing the upright pins 3 and 3' respectively of the front and rear trolleys to be engaged with and inserted automatically into the holes formed in the engaging members 2 and 2' of the truck, whereby the trolley units are engaged with the front and rear of the truck. Therefore, the truck can be pushed manually along the storage rail up to the conveyance path.

Figure 4:
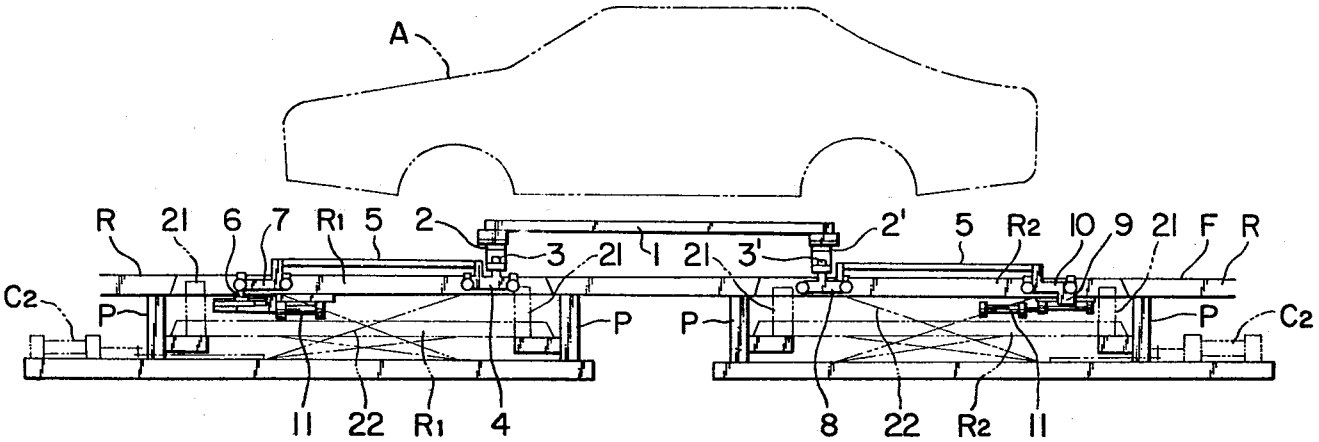
FIG. 4 is a front view of a storage equipment according to another embodiment of the invention.
Figure 5:
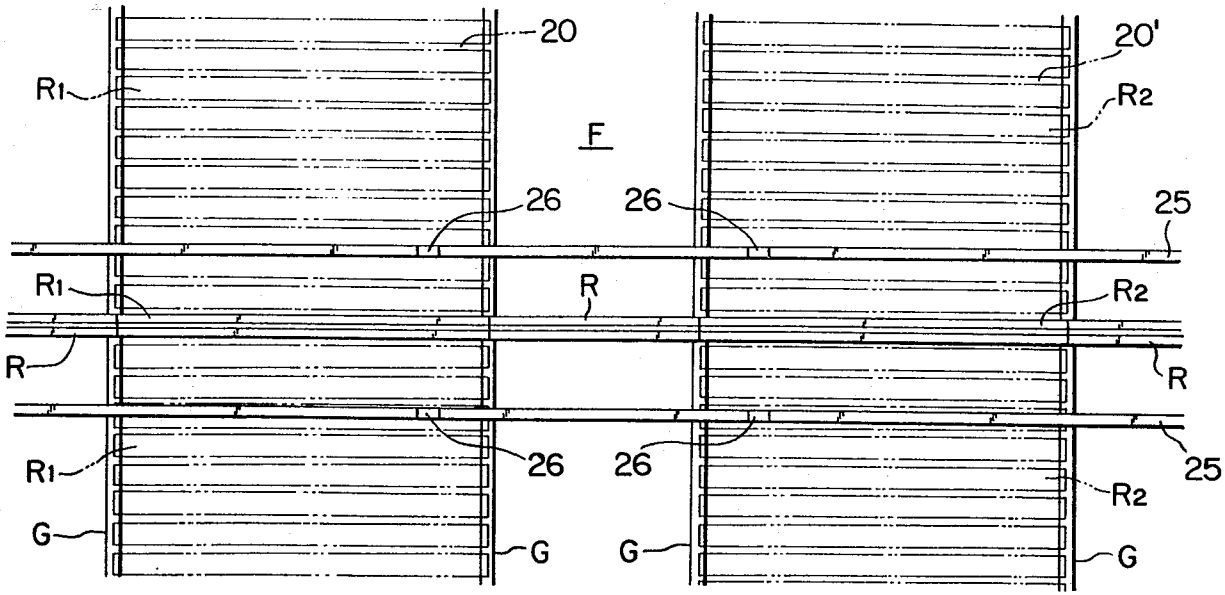
FIG. 5 is a plan view thereof.

According to another embodiment of the invention, as shown in FIGS. 4 and 5, rail-displacement means such as storage conveyors 20 and 20' are disposed under the truck conveyor in the trolley storage location. The rail segments or portions $R_1$ and $R_2$ in this embodiment also serve as trolley storage rails and are disposed side by side in a generally parallel arrangement in large numbers on the storage conveyors 20 and 20', respectively, and each includes elevator or lift means enabling independent vertical displacement of said rail portions $R_1$ and $R_2$.

Figure 6:
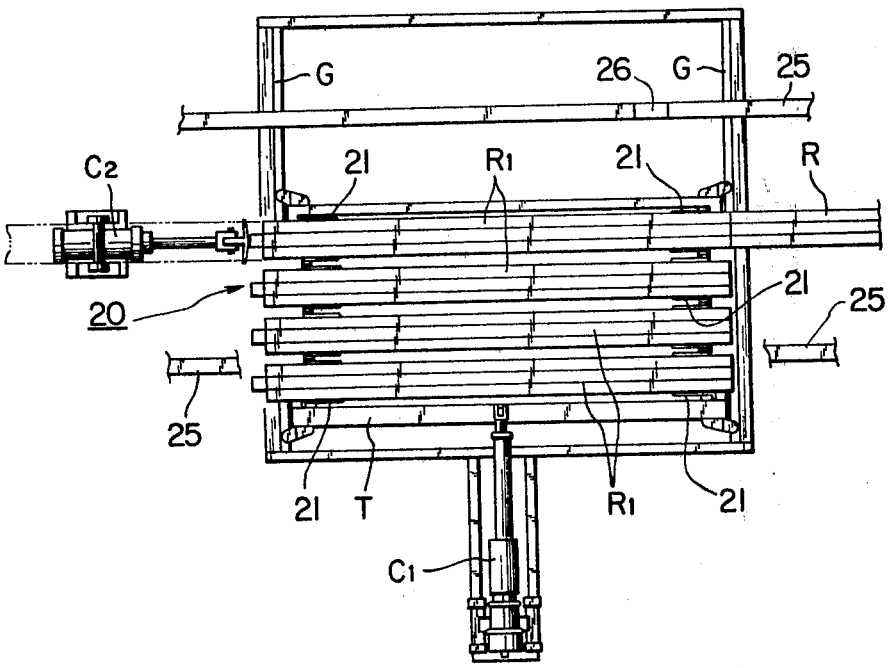
FIG. 6 is a plan view of a storage conveyor for a front trolley unit shown in FIG. 4.
Figure 7:
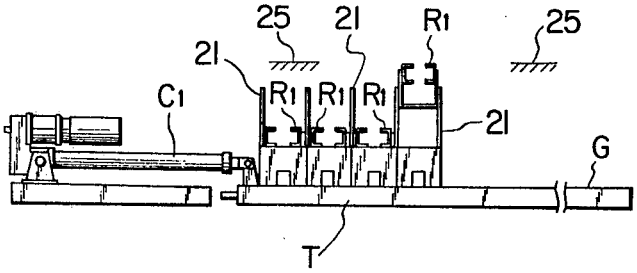
FIG. 7 is a side view of the principal part of the storage conveyor shown in FIG. 4.
Figure 8:
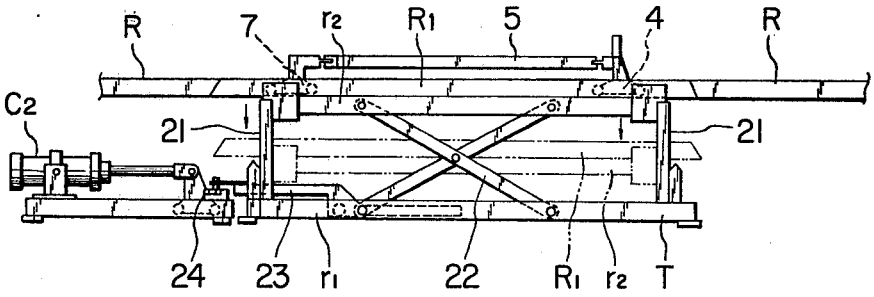
FIG. 8 is a front view thereof.

In other words, the storage conveyors 20 and 20' are disposed under the segmented portion of the trolley running rail R and, as shown in detail in FIG. 6, the storage conveyors 20 and 20' each have an underframe T having wheels for moving on parallel spaced rails G and a cross-feed cylinder $C_1$ for displacing the underframe T perpendicular to the trolley running rail. The cylinder $C_1$, and the storage conveyors 20 and 20' function as rail displacement means for displacing the series of rail portions $R_1$ and $R_2$ from at least second inoperative positions out of registry with the operative position of the rail running R and a first inoperative position in registry with the operative position. On the upper surface of the underframe T, as shown in FIG. 7, there are mounted upright a large number of guide bars 21 for guiding the vertical movement of the rail portions $R_1$ and $R_2$, between a lower first inoperative position spaced from the running rail R, and an operative position in communication with the running rail R. Between each pair of adjacent guide bars 21 there is stored a single rail segment $R_1$ or $R_2$ disposed in a parallel arrangement while being carried on lift or elevator means, for example a lifting cross-lever 22, so that each segment is independently vertically movable between th first inoperative position and the operative position. More particularly, as shown in FIG. 8, the driven cross-lever 22 serves as displacement means for displacing the rail segment between the operative and the first inoperative positions. The lower end of one link of the lifting cross-lever 22 is pivotally connected to a lower rail $r_1$ which is laid on the underframe T, and the upper end of the same link is pivoted to an upper rail $r_2$ which is attached to the lower surface of the rail portion $R_1$, while both upper and lower ends of the other link of the cross-lever 22 are free so as to be adapted to move within the upper rail $r_2$ and the lower rail $r_1$, respectively. To the lower end of the free end link of the cross-lever 22 there is fixed one end of an actuating rod 23, the other end of which is in detachable engagement with an engaging member 24 attached to the piston rod end of a cross-lever actuating cylinder device $C_2$ which is disposed under the trolley running rail R.

As shown in FIGS. 5 and 7, a running path 25 for the truck wheels is provided, and V-grooves 26 are formed in the trolley-storage position of the running path 25 for retaining the wheels of the truck and for keeping the truck stopped in the trolley-storage position. The lift means is not limited to the cross-lever. Other conventional lift means such as screw-type, gear-type and fluid-pressure type lift means are employable.

In operation of this embodiment of the invention, the piston rod of the cross-lever actuating cylinder device $C_2$ is moved forward, and the actuating rod 23 is moved to the right (in FIG. 8), thus causing the cross-lever 22 to go up. The rail segment $R_1$ positioned just under the segmented portion of the trolley running rail R and carried on the storage conveyor 20 is moved upward along the guide bars 21 from the bottom inoperative position shown in phantom lines in FIG. 8 to the upper operative position shown in solid lines in FIG. 8. The rail portion $R_1$ reaches the segmented portion of the running rail R at its upper operative position where the segmented rail portion $R_1$ is aligned with with the running rail R, where it waits for the arrival of the front-side trolley unit. When the truck 1 has arrived at the trolley storage position and the truck wheels fitted in the wheel-retaining V-grooves 26, the truck stops and the front-side trolley unit also stops within the rail portion $R_1$ and is held by the pivotable stopper S and the pushing piece 13 of the above-described positioning means. Then, upon backward movement of the piston rod of the cross-lever actuating cylinder device $C_2$, the actuating rod 23 is moved to the left (in FIG. 8), thus causing the cross-lever 22 to go down, so that the scissioned rail portion $R_1$ is moved down along the guide bars 21 from the upper position shown in solid line to the bottom first inoperative position shown in phantom line in FIG. 8 until it is put on the storage conveyor 20. In the first inoperative position, the scissioned rail portion $R_1$ is out of communication with the running rail R but is in a position from which it is displaceable into a second inoperative position from which it cannot be displaced directly into its operative position. When the rail segment $R_1$ is in the bottom position, the cross-feed cylinder device $C_1$ is actuated to move the storage conveyor 20 up to the position where the next rail portion $R_1$ is displaced from a second inoperative storage position to the first inoperative position just under the scissioned portion of the trolley running rail R. Thereafter the piston rod of the cross-lever actuating cylinder device $C_2$ is moved forward and the same operations as the previously-noted operations are repeated, whereby the front-side trolley units which have arrived at the storage position are stored successively on the storage conveyor 20.

By reversing the above-mentioned operation the front-side trolley units thus stored can be drawn out from the storage position and engaged onto the trolley running rail R.

Engagement and disengagement of the front-side trolley unit with respect to the truck 1 can be done easily because the upright pin 3 of the front trolley 4 can be fitted in and disengaged from the vertical receiving hole formed in the engaging member 2 of the truck.

As to the rear-side trolley unit, the storage conveyor 20' has the same construction as the foregoing construction of the storage conveyor 20, and the storage and drawing out of the rear-side trolley unit are effected by the same operation as in the storage and drawing out of the front-side trolley unit. Therefore, the specific explanation of the operation of the rear-side trolley unit is omitted.

The storage conveyor is not limited to the reciprocating cross-feed type described in the above embodiment; it may be of a circular turntable type storing thereon a large number of scissioned rail portions radially, and in this case a driving device for rotation of the turntable is disposed in place of the cross-feed cylinder device $C_1$.

Figure 9:
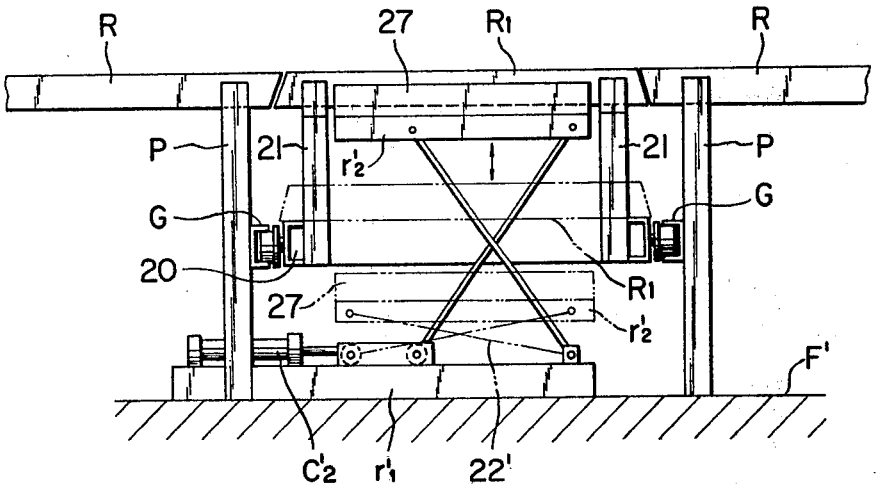
FIG. 9 is a front view of a storage conveyor according to a further embodiment of the invention.

In the above embodiment, moreover, the lifting cross-lever 22 is disposed between the lower rail $r_1$ and the upper rail $r_2$ on each of the storage conveyors 20 and 20'. However, according to a further embodiment of the invention there may be adopted such a construction as shown in FIG. 9 wherein only the opposing ends of the rail portions $R_1$ and $R_2$ are supported on the respective storage conveyors 20 and 20' and a lifting cross-lever 22' is mounted only on the floor F' just under the segmented portion of the trolley running rail R, and the central portion of the rail segments $R_1$ and $R_2$ is supported by a vertically-movable rail support 27 mounted on an upper rail $r_2$ of the cross-lever 22'. In FIG. 9, columns P are mounted upright on the floor F' for supporting the trolley running rail R. A large number of guide bars 21 project upwardly from the opposing sides of the underframe T of the storage conveyor. The storage conveyor is moved transversely on the rails G by the cross-feed cylinder device $C_1$, and between adjacent guide bars 21 there is interposed one rail segment $R_1$ while both end portions thereof are carried on the underframe T.

Consequently, when one of the rail segments $R_1$ disposed on the underframe of the storage conveyor 20 has been positioned under the segmented portion of the running rail R, when the piston rod of a cross-lever actuating cylinder device $C'_2$ is moved forward, the cross-lever 22' rises and causes the rail segment $R_1$ to go up along the guide bars 21. The rail segment support 27 carries the rail portion $R_1$ so that the rail portion $R_1$ is lifted from the bottom position indicated in chain lines to the upper position indicated by solid lines in FIG. 9 to connect it to the trolley running rail R. Then, if the piston rod of the cross-lever actuating cylinder device $C'_2$ is moved backward, the cross-lever 22' is brought down, so that the rail portion $R_1$ goes down together with the rail segment support 27 while being guided by the guide bars 21 and rests on the underframe T of the storage conveyor, while the upper rail $r_2$ fixed to the cross-lever 22' and the rail portion support 27 mounted thereon are returned to the lowest position indicated with chain lines. In this state, if the cross-feed cylinder device $C_1$ is actuated, the next rail portion $R_1$ disposed on the underframe T of the storage conveyor is moved and positioned in the segmented portion of the trolley running rail R.

Thus, unlike the embodiment shown in FIG. 8, there is no need to provide the cross-lever 22 for each scissioned rail portion as only one cross-lever 22' may be provided just under the scissioned portion of the trolley running rail R and below the storage conveyor such that the scissioned rail portions are vertically movable.

Furthermore, since the engagement and disengagement of the front-side and rear-side trolley units with respect to the truck are effected through upright pins, the rising and falling motion of each trolley unit makes it possible to perform the engaging and disengaging operation for the truck extremely smoothly and easily.

In the present invention, as set forth hereinbefore, the trolley units are adapted to run within a conveyance path while being engaged with a truck and can be attached to and detached from the truck without human assistance by raising and lowering the rail segment which is formed as part of the trolley running rail. The trolley units once disconnected from the truck can then be stored in large numbers in a storage place without human assistance, while the stored trolley units can be easily drawn out and attached to the truck. Besides, the truck once disengaged from the trolley units can move freely on the floor without suffering any restriction, so it is possible to store trucks in a predetermined place.

According to the present invention, therefore, the number of trucks to be used within a conveyance path can be adjusted easily and quickly so the conveyance efficiency by the truck conveyor can be improved to a remarkable extent. Additionally, the working floor can be utilized efficiently because the trolleys are stored below the working floor.

Moreover, in the embodiment shown in FIG. 9, since the trolleys can be stored below the working floor just under the segmented portion of the trolley running rail, a remarkable reduction of the storage area and an efficient utilization of the working floor are attainable. Furthermore, the trolleys can be brought into an adjacent relation to the trolley running rail or brought onto the storage conveyor by a mere up-and-down motion just under the scissioned portion of the trolley running rail, so that the transfer of trolley onto the trolley running rail and the operation for its movement from the trolley running rail and to the storage position become attainable extremely easily and in a shorter time. Thus, the efficiency of the storage and removal operation is improved.

What is claimed is:

1. A storage arrangement for conveyor trolleys, comprising:

(a) a front trolley unit;

(b) a rear trolley unit;

(c) an article carrier for receiving an article for conveyance having trolley-engagement means detachably engageable with said front and rear trolley units;

(d) a running rail means for guiding said front and rear trolley units along a selected conveyance path, said front and rear trolley units having rail-engagement means for engaging said rail means;

(e) storage rail means at a selected storage location along said conveyance path for storing said front and rear trolley units;

(f) transfer rail means at said storage location, said transfer rail means in a first position cooperating with said running rail means to enable transfer of said front and rear trolley units between said running and said transfer rail means, and in a second position cooperating with said storage rail means to enable transfer of said front and rear trolley units between said transfer and said storage rail means;

(g) transfer-rail displacement means for displacing said transfer rail means between said first and second positions; and (h) transfer drive means at said storage location for transferring said front and rear trolley units between said storage rails and said transfer rails.

2. A storage arrangement in accordance with claim 1 wherein said storage rail means comprises a plurality of said storage rails, with each storage rail having an operative position in communication with said transfer rails when positioned at said second position, and inoperative positions out of communication with said transfer rails when positioned at said second position, and storage rail displacement means for displacing each of said storage rails between said operative position and said inoperative positions.

3. A storage arrangement in accordance with claim 2 wherein said storage rail displacement means comprises storage-rail carrier means supporting and carrying said plurality of storage rails thereon, and carrier drive means cooperating with said carrier means to displace said carrier means and each of said plurality of trolley-storage rails carried thereon serially between the respective operative and inoperative positions.

4. An arrangement in accordance with claim 3 wherein said storage-rail carrier means comprises a cross-feed conveyor which said storage rails are carrried in a side-by-side generally parallel arrangement, and wherein further said carrier drive means moves said conveyor in a direction transverse to said parallel arrangement of said storage rails.

5. A storage arrangement in accordance with claim 1 wherein said running rail is vertically higher than said storage rails and wherein further said transfer-rail displacement means comprises elevator means for raising and lowering said transfer rails between said first and second positions.

6. A storage arrangement in accordance with claim 1 wherein said transfer drive means includes pusher means engageable with said front and rear trolley units when in said first position and separable to displace said front and rear trolley units between said storage rails and said transfer rails when in said second position.

7. An arrangement according to claim 1 wherein said trolley-engagement means have a connecting element which automatically disengages said trolley units when said transfer rail is displaced from said first position to said second position.

8. A storage arrangement for conveyor trolleys, comprising:

(a) a front trolley unit;

(b) a rear trolley unit;

(c) an article carrier for receiving an article for conveyance having trolley-engagement means detachably engageable with said front and rear trolley units at the respective front and rear of said article carrier;

(d) a running rail for guiding said front and rear trolley units along a selected conveyance path, said front and rear trolley units having rail-engagement means for engaging said running rail;

(e) a plurality of storage rails provided at a selected storage location along said conveyance path for storing said front and rear trolley units, each trolley-storage rail having an operative position in operable communication with said running rail to enable transfer of said front and rear trolley units between said running and storage rails, and an inoperative position out of communication with said running rail, said trolley-engagement means of said article carrier being engageable with said front and rear trolley units in said operative position and disengaged in said inoperative position to enable storage of said front and rear trolley units independently of said article carrier; and (f) rail displacement means for displacing each of said storage rails between said operative position and inoperative positions.

9. A storage arrangement in accordance with claim 8 wherein each of said storage rails has a first inoperative position displaceable in registry with said operative position and at least a second inoperative position out of registry with said operative position, said rail displacement means comprising first displacement means including rail carrier means for supporting and carrying said storage rails, and drive means for displacing each of said storage rails between said first and second inoperative positions, and second displacement means at said first inoperative position for displacing said storage rails between said first inoperative position and said operative position.

10. A storage arrangement in accordance with claim 9 wherein said running rail is vertically higher than said storage rails when in said first or second inoperative positions, and wherein further said second displacement means includes elevator means engageable with said trolley-storage rails at said first inoperative position for vertically displacing said trolley-storage rails between said first inoperative position and said operative position.

11. A storage arrangement in accordance with claims 9 or 10 wherein said storage rails are disposed on said rail-carrier means in a side-by-side generally parallel arrangement and said drive means displaces said storage rails transversely to said parallel arrangement.

12. A storage arrangement in accordance with claim 11 including a separate elevator means for each storage rail.

* * * * *

UNITED STATES PATENT AND TRADEMARK OFFICE

CERTIFICATE OF CORRECTION

PATENT NO. : 4,440,090

DATED : April 3, 1984

INVENTOR(S) : Masasumi Murai, Hirokazu Kondo & Shigekatzu Takino

It is certified that error appears in the above-identified patent and that said Letters Patent is hereby corrected as shown below:

Column 2, line 45, "l-shaped" should read --]-shaped--.
Column 3, line 2, "l-shaped" should read --]-shaped--;
line 66, "wih" should read --with--.
Column 5, line 66, "th" should read --the--.

Signed and Sealed this

First Day of January 1985

[SEAL]

*Attest:*

GERALD J. MOSSINGHOFF

*Attesting Officer*

*Commissioner of Patents and Trademarks*